US005915647A

United States Patent [19]

Van Deurse

[11] Patent Number: 5,915,647

[45] Date of Patent: Jun. 29, 1999

[54] ONE-PIECE CORE PLUG

[75] Inventor: Michael Van Deurse, Norton, Mass.

[73] Assignee: Double E. Company, Inc., West Bridgewater, Mass.

[21] Appl. No.: 08/907,541

[22] Filed: Aug. 8, 1997

[51] Int. Cl.[6] ..... B65H 75/08

[52] U.S. Cl. ..... 242/597.5; 242/596.7; 242/613.4; 242/613.5

[58] Field of Search ..... 242/596.7, 597.5, 242/598.4, 599.4, 612, 613.4, 613.5, 118.31

[56] References Cited

U.S. PATENT DOCUMENTS

| | | | |
|---|---|---|---|
| 2,187,580 | 1/1940 | Young et al. | 242/597.5 |
| 2,250,675 | 7/1941 | Markle, Jr. | 242/596.7 |
| 2,375,679 | 5/1945 | Obedin . | |
| 2,562,923 | 8/1951 | Kolivoski | 242/597.7 |
| 3,260,362 | 7/1966 | Schwinne | 242/613.4 |
| 3,456,892 | 7/1969 | Krumbein et al. | 242/597.5 |
| 3,510,082 | 5/1970 | Sexton et al. . | |
| 3,519,216 | 7/1970 | Rienzi et al. . | |
| 3,567,146 | 3/1971 | Arenson | 242/613.5 |
| 3,615,063 | 10/1971 | Bates | 242/613.5 |
| 3,627,220 | 12/1971 | Vogel | 242/613.5 |
| 4,171,781 | 10/1979 | Kral et al. | 242/598.4 |
| 4,830,305 | 5/1989 | Guggi et al. | 242/596.7 |
| 5,322,234 | 6/1994 | Robert et al. | 242/596.7 |
| 5,513,820 | 5/1996 | Meyer | 242/118.31 |

*Primary Examiner*—John P. Darling
*Attorney, Agent, or Firm*—Hale and Dorr LLP

[57] ABSTRACT

A core plug includes a tube formed from a light-weight material, such as woven carbon fibers, inserted into and connected to a steel rib assembly. The rib assembly includes a series of ribs surrounding the tube, where each rib includes a beam parallel to the tube and columns connecting the beams to the tube. The tube can extend the complete length of the rib assembly or the rib assembly can extend beyond the end of the tube. A high molecular weight journal is inserted in the outer end of the tube.

19 Claims, 4 Drawing Sheets

ONE-PIECE CORE PLUG

FIELD OF THE INVENTION

This invention relates to core plugs and, more particularly, to core plugs formed into a single piece.

BACKGROUND OF THE INVENTION

In manufacturing and other operations, a roll of material may need to be mounted onto or off a roll. In some applications, particularly in the paper industry, such as with the manufacturing of paper towels, it is desirable to include a core plug in either end of the core. Once the core plugs are mounted into the core, the core plugs are then mounted to a roll stand, which fits into the journals of the core plugs.

Core plugs must have high strength, to withstand both the forces to which they are subjected during normal use and the forces that result from the core plugs being dropped during insertion or removal from a core. Also, they should be easy to assemble and insert into a core.

Existing core plugs tend to be heavy (typically, approximately 80 pounds), inconvenient to use and to assemble, and to have inadequate durability.

In some cases, existing core plugs take the form of a plastic plug with a separate steel tube that fits into the center of the plug at its outer end and a steel journal. These plugs tend to be heavy. Moreover, the tube tends to wear out the inside of the plastic plug. In other cases, existing core plugs are made from aluminum, with an aluminum plug and an aluminum tube, but these tend to fail from metal fatigue, abuse, or other causes and can be very heavy.

SUMMARY OF THE INVENTION

According to the present invention, these and other problems and disadvantages are corrected by using a core plug that is formed into a single piece. The core plug is in the form of a shaft surrounded by a set of ribs. Preferably, the ribs are formed from steel, for high strength and durability, with spokes extending toward the center. Preferably, the ribs each have three spokes. In a preferred embodiment, the corresponding spokes of each rib are welded to separate steel bands and then the entire rib assembly is heat-treated.

Different diameter core plugs can be obtained from the same basic design by cutting the spokes to different lengths. This permits the same spoke design to be fitted to many different cores, thereby avoiding additional tooling costs.

The shaft is formed from a carbon-fiber tube and (unlike existing core plugs) extends beyond the outer end of the plug. Preferably, the tube extends to at least two of the spokes of each rib and it may, but it need not, extend to the inner end of the plug. The use of carbon-fiber instead of steel greatly reduces the weight of the plug while providing the desired high strength. Preferably, the portion of the tube that extends outside of the plug is covered with a thin steel sleeve, to provide abrasion resistance.

The rib assembly is attached to the tube, preferably by welding. In place of the conventional steel journal, a high molecular weight polymer is inserted into the end of the tube, for mounting the core plug to the roll stand. The polymer journal reduces the weight of the core plug and has excellent wear properties.

The resulting one-piece core plug provides low weight, high strength, and durability, all of which also makes the core plug relatively easy to handle.

DETAILED DESCRIPTION OF PREFERRED EMBODIMENTS

Figure 1:
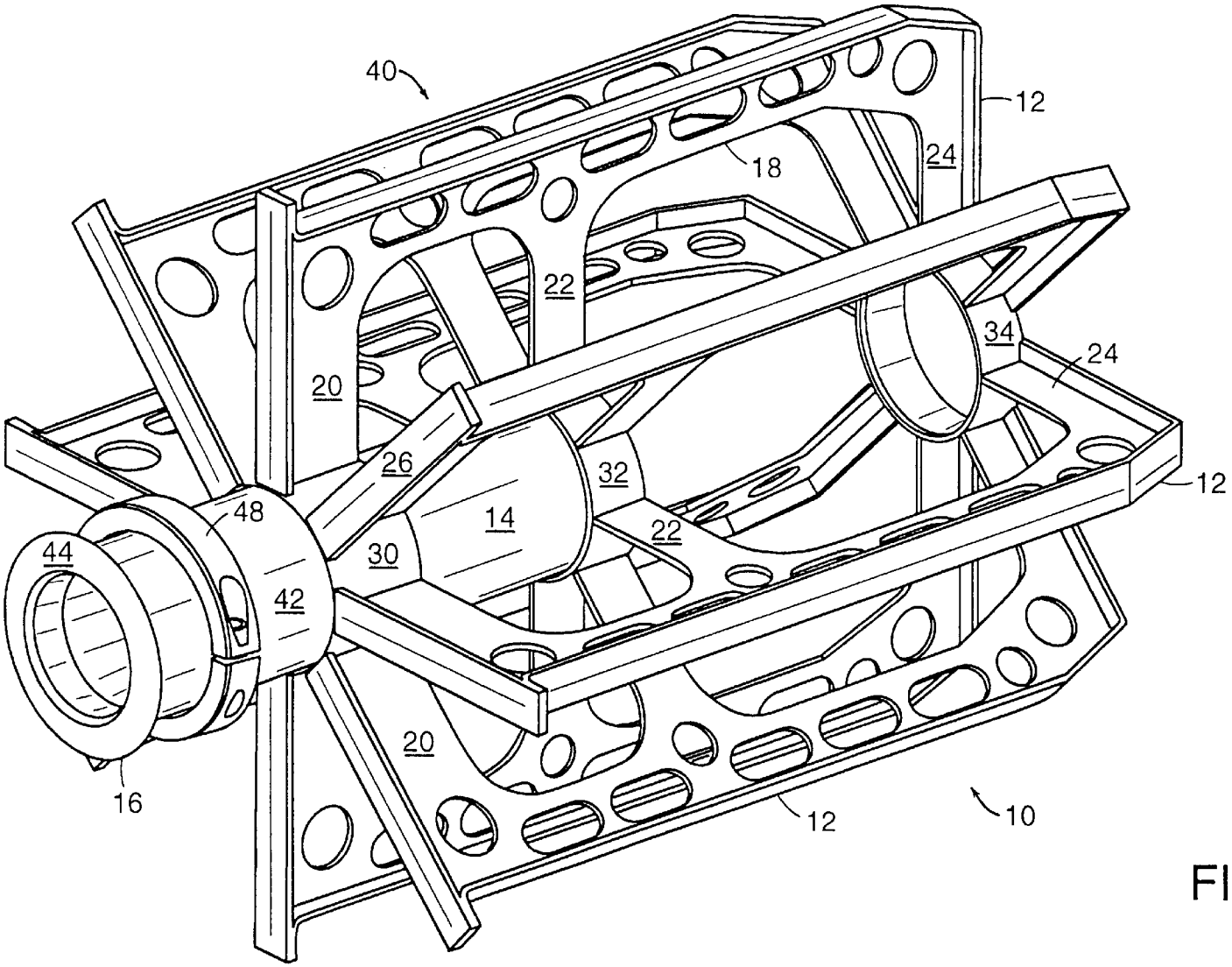
FIG. 1 is a perspective view of a core plug according to one embodiment of th present invention.
Figure 3:
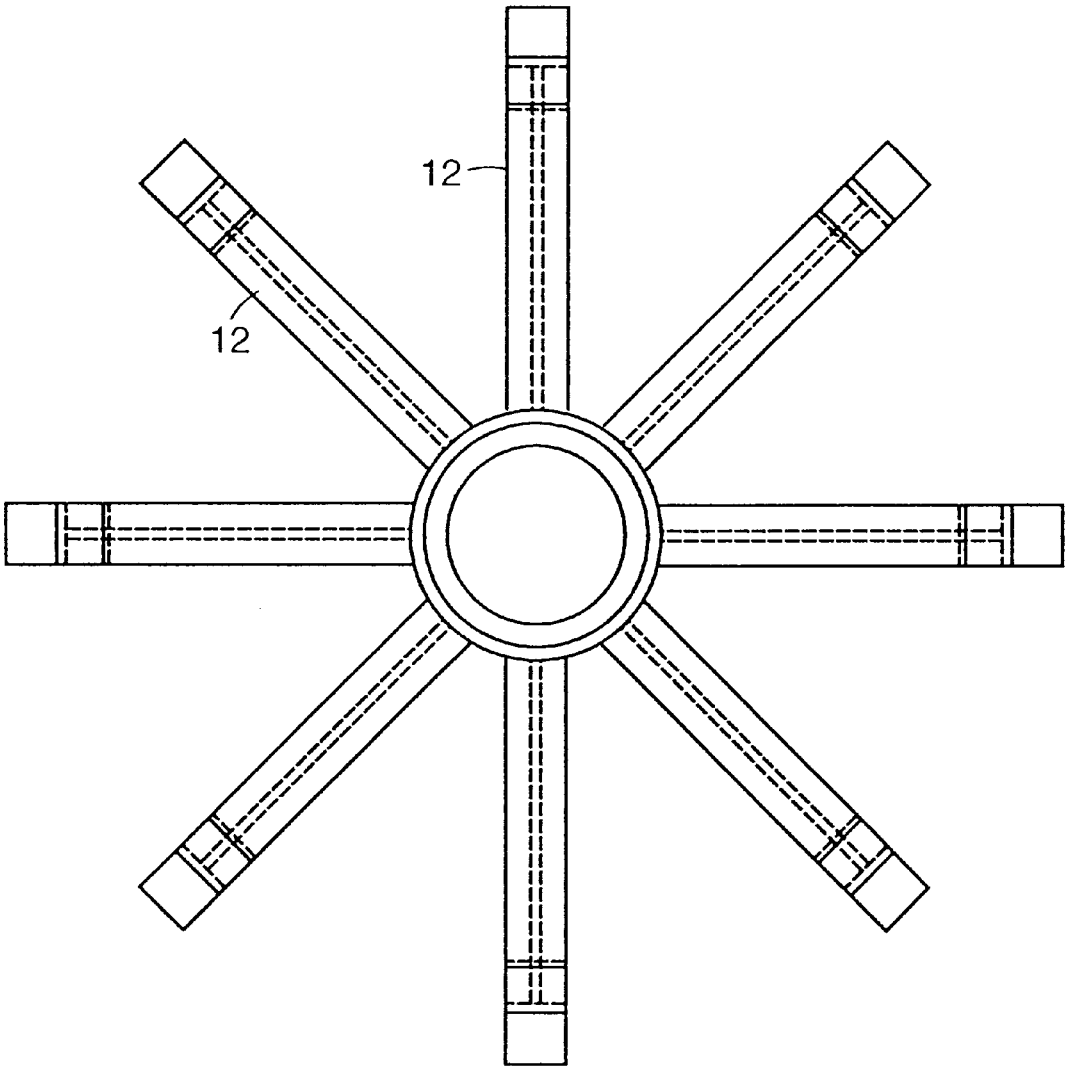
FIG. 3 is an end view of a core plug according to the present invention.
Figure 4:
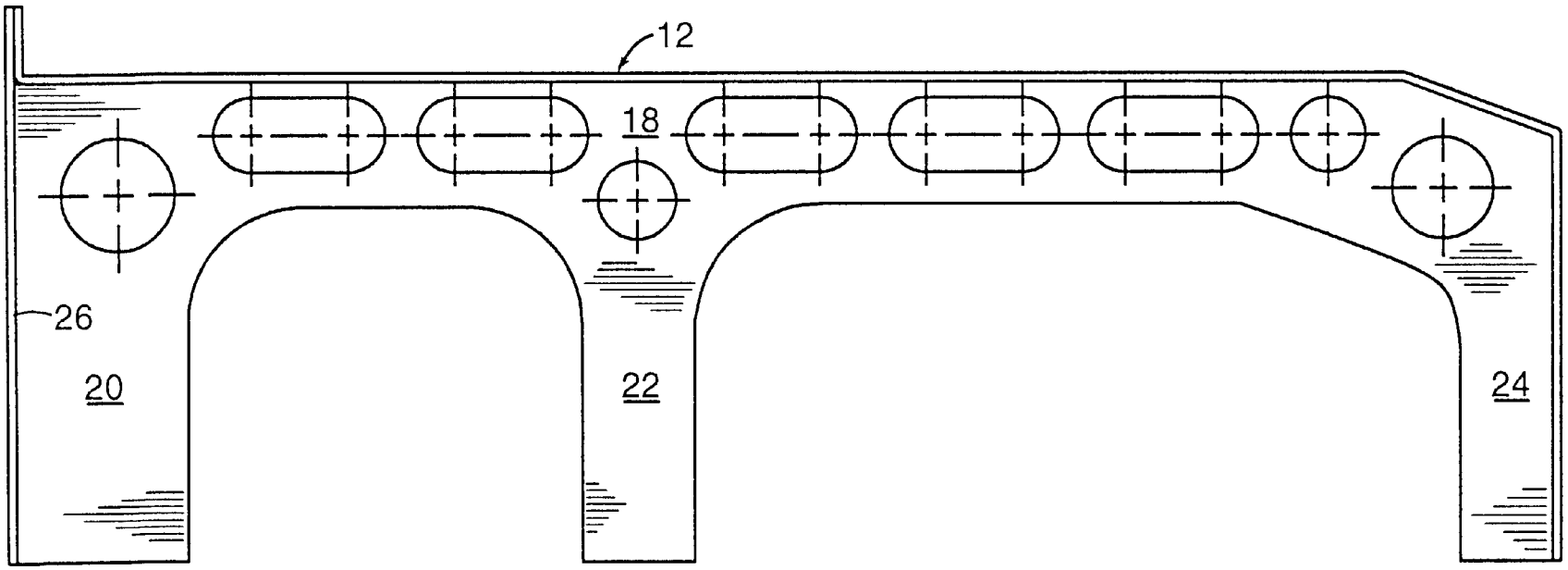
FIG. 4 is a side view of a rib of a core plug according to the present invention.

Referring to FIGS. 1, 3, and 4, core plug assembly 10 includes ribs 12, tube 14, and journal 16. Preferably, ribs 12, tube 14, and journal 16 are connected to form a one-piece core plug assembly.

Each rib 12 has a beam 18 extending the length of rib 12; and an outer column 20, a middle column 22, and an inner column 24, all extending radially inward from beam 18. The outer side 26 of outer column 20 is flanged. The inner end of outer column 20 of each rib 12 is welded to band 30, the inner end of middle column 22 of each rib is welded to band 32, and the inner end of inner column 24 of each rib 12 is welded to band 34 to create rib assembly 40. Preferably, rib assembly 40 is then heat-treated. In a preferred embodiment, each rib 12 and bands 30, 32, and 34 are formed from steel, which provides good strength and durability, although other materials could be used.

Figure 2:
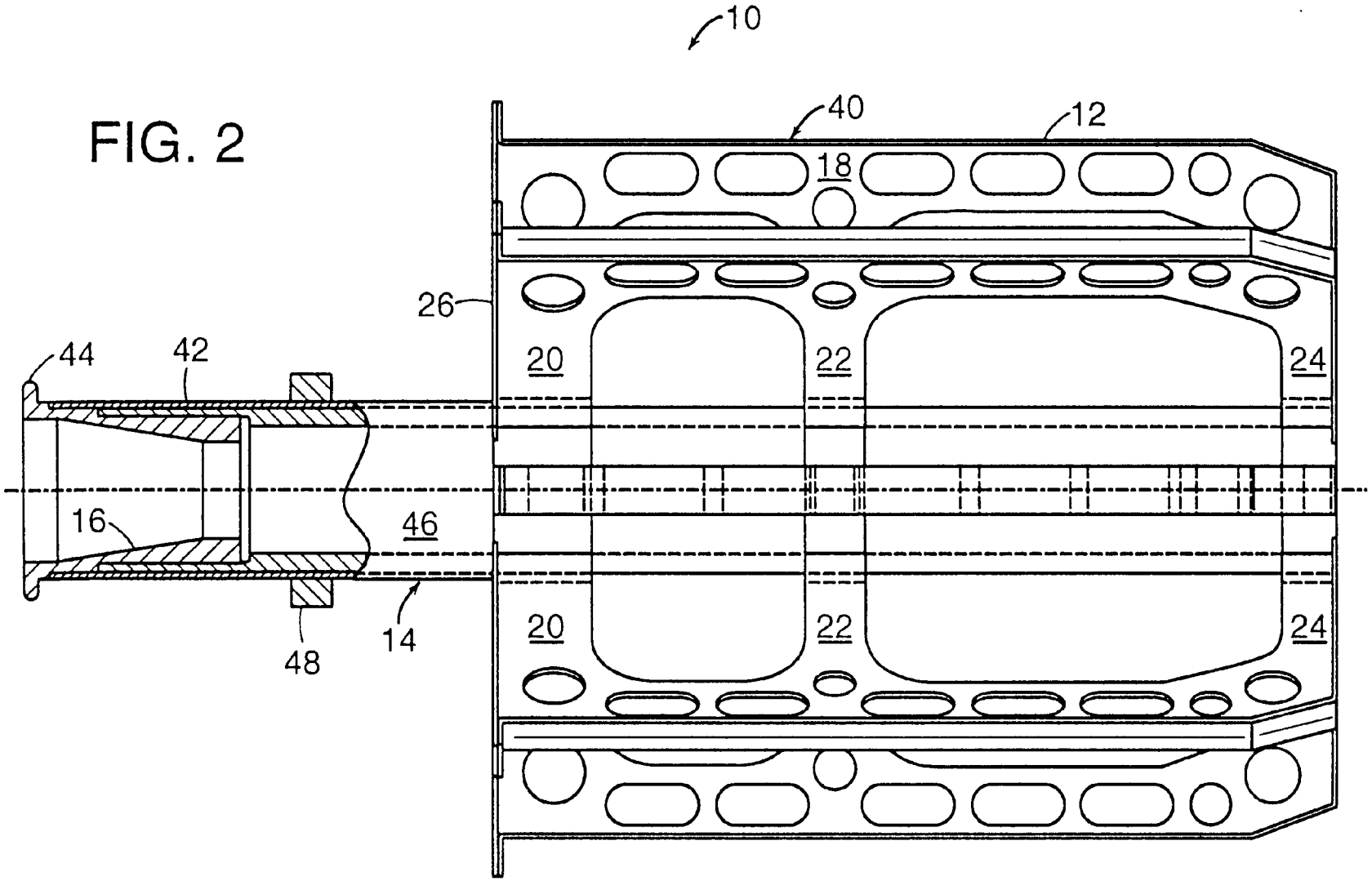
FIG. 2 is a partial cut-away side view of a core plug according to a second embodiment of the present invention.

Tube 14 is made from woven carbon-fibers, which are significantly lighter than steel, with a similar strength. The outer portion 46 of tube 14 is covered with steel sleeve 42 to resist abrasion. Alternatively, other abrasionresistant materials could be used for the sleeve. Tube 14 extends into rib assembly 40 to the inner end of middle column 22, and is welded to outer band 30 and middle band 32. Alternatively, with this embodiment, inner band 34 can be omitted. In a different embodiment, tube 14 extends all the way through rib assembly 40 to inner column 24, as shown in FIG. 2. Although typically heavier, steel, aircraft aluminum, or other materials could be used for tube 14.

Journal 16 is formed from a high molecular weight polymer and is inserted in the outer end of tube 14. Preferably, the portion of journal 16 that extends out of tube 14 has the same outer diameter as tube 14 and has a flanged end 44. In a preferred embodiment, journal 16 is formed from an ultra-high molecular weight polymer, such as the Gar-Dur UHMW polymer manufactured by Garland Manufacturing Company, Saco, Me. Such a polymer is much lighter than steel, resists abrasion and corrosion, and provides a low-friction surface that reduces wear. Alternatively, however, a steel journal could be used.

Clamp collar 48 extends around the outer portion 46 of tube 14 and may be adjusted to a preferred position along the journal. Typically, a crane is used to lift a core with the core plugs inserted. The hooks from the crane can be placed between the end of rib assembly 40 and clamp collar 48, to prevent the hooks from slipping off the core plug.

In one embodiment, eight ribs are used for a 15.75-inch diameter (exclusive of the flanged portion of outer side 26 of outer column 20) core plug, in which rib assembly 40 is 19 inches long, not including the flanged portion, and 19.27 inches long including the flanged portion. Tube 14 has an outer diameter of 4 inches. Journal 16 is approximately 5 inches long and extends approximately 1.5 inches beyond the end of tube 14. The outer end of journal 16 extends approximately 10.63 inches past the end of rib assembly 40, so that the overall length of core plug 10 is approximately 29.90 inches. The flanged end 44 of journal 16 has an outer diameter of approximately 4.88 inches. Clamp collar 48 has an outer diameter of approximately 5.25 inches and is approximately 0.88 inches wide. The resulting core plug weighs approximately 40 pounds. Each of these dimensions can be adjusted as desired for a particular application. By cutting columns 20, 22, and 24 to a different length before welding them to bands 30, 32, and 34, a different diameter core plug is obtained.

While there have been shown and described examples of the present invention, it will be readily apparent to those skilled in the art that various changes and modifications may be made therein without departing from the scope of the invention as defined by the appended claims. Accordingly, the invention is limited only by the following claims and equivalents thereto.

What is claimed is:

1. A core plug comprising:

a tube having an inner portion and an outer portion;

a plug having a plurality of ribs, each rib having a plurality of connecting columns having an inner end connected to the inner portion of the tube and an outer end extending radially outward from the tube, each rib further having a beam extending substantially parallel to the tube and connected to the outer end of each of the plurality of connecting columns, wherein the outer end of the tube extends from a first end of the plug; and a journal connected to the outer portion of the tube.

2. The core plug of claim 1, wherein each rib further has a non-connecting column having an outer end connected to the beam and an inner end extending radially inward from the beam, and wherein the inner portion of the tube does not extend to the non-connecting column.

3. The core plug of claim 2, wherein the plug has a plurality of connecting bands, each band being connected to the inner end of one of the connecting columns of each rib and to the inner portion of the tube.

4. The core plug of claim 3, wherein each of the plurality of connecting bands is welded to the inner end of one of the connecting columns of each rib.

5. The core plug of claim 3, wherein the beam, each column, and each band of each rib includes steel.

6. The core plug of claim 1, wherein each rib includes steel.

7. The core plug of claim 1, wherein the tube includes woven carbon fibers.

8. The core plug of claim 7, wherein the tube includes a steel sleeve surrounding the outer portion of the tube.

9. The core plug of claim 7, wherein the tube includes an abrasion-resistant sleeve surrounding the outer portion of the tube.

10. The core plug of claim 9, wherein the journal includes a high molecular weight polymer.

11. The core plug of claim 1, wherein the journal has a first end inserted into the outer portion of the tube and a second end extending beyond the outer portion of the tube.

12. The core plug of claim 11, wherein the journal includes a high molecular weight polymer.

13. A one-piece core plug comprising:

a tube having an inner portion and an outer portion;

a rib assembly having a plurality of ribs around the inner portion of the tube, each rib having a beam extending substantially parallel to the tube, and a plurality of parallel connecting columns extending from the beam to the inner portion of the tube; and a journal connected to the outer portion of the tube.

14. The core plug of claim 13, wherein a first end of each beam is connected to a first of the plurality of connecting columns and a second end of each beam is connected to a second of the plurality of connecting columns.

15. The core plug of claim 13, wherein a first end of each beam is connected to a first of the plurality of connecting columns; wherein each rib further has a non-connecting column, parallel to the plurality of connecting columns, extending inward from a second end of the beam; and wherein the second end of each beam extends beyond the inner portion of the tube.

16. The core plug of claim 13, wherein the tube includes an abrasion-resistant sleeve surrounding the outer portion of the tube.

17. The core plug of claim 16, wherein the tube includes woven carbon fibers.

18. The core plug of claim 17, wherein the rib assembly includes heat-treated steel.

19. The core plug of claim 18, wherein the journal includes a high molecular weight polymer.

* * * * *